US007910531B2

(12) United States Patent
Sabnis et al.

(10) Patent No.: US 7,910,531 B2
(45) Date of Patent: Mar. 22, 2011

(54) COMPOSITION AND METHOD FOR PRODUCING COLORED BUBBLES

(75) Inventors: Ram W. Sabnis, Eagan, MN (US); Timothy D. Kehoe, St. Paul, MN (US)

(73) Assignee: C2C Technologies LLC, St. Paul, MN (US)

( * ) Notice: Subject to any disclaimer, the term of this patent is extended or adjusted under 35 U.S.C. 154(b) by 1148 days.

(21) Appl. No.: 11/150,975

(22) Filed: Jun. 13, 2005

(65) Prior Publication Data

US 2006/0004110 A1 Jan. 5, 2006

Related U.S. Application Data

(60) Provisional application No. 60/581,294, filed on Jun. 17, 2004.

(51) Int. Cl.
*C11D 1/84* (2006.01)

(52) U.S. Cl. ..... 510/100; 252/545; 524/253

(58) Field of Classification Search ..... 510/100, 510/135, 510; 252/545; 524/253
See application file for complete search history.

(56) References Cited

U.S. PATENT DOCUMENTS

| | | | | |
|---|---|---|---|---|
| 1,112,180 | A | 9/1914 | Westenfelter | |
| 1,717,723 | A | 6/1929 | McCall | |
| 2,445,994 | A | 7/1948 | Benson at al. | |
| 2,451,022 | A | 10/1948 | Dohrmann | |
| 3,332,743 | A | 7/1967 | Green | |
| 3,382,607 | A | 5/1968 | Ryan et al. | |
| 3,443,337 | A * | 5/1969 | Ehrlich | 446/19 |
| 3,454,344 | A | 7/1969 | Ryan et al. | |
| 3,617,325 | A | 11/1971 | Spokes et al. | |
| 3,650,831 | A | 3/1972 | Jungermann et al. | |
| 3,846,452 | A | 11/1974 | Horiguchi et al. | |
| 3,957,964 | A | 5/1976 | Grimm, III | |
| 3,975,405 | A | 8/1976 | Hamill | |
| 4,016,089 | A | 4/1977 | Regan et al. | |
| 4,071,614 | A | 1/1978 | Grimm, III | |
| 4,071,645 | A | 1/1978 | Kahn | |
| 4,098,577 | A | 7/1978 | Halpern | |
| 4,139,965 | A | 2/1979 | Curry et al. | |
| 4,150,106 | A | 4/1979 | Assal et al. | |
| 4,177,300 | A | 12/1979 | Fearing | |
| 4,206,069 | A | 6/1980 | Borrello | |
| 4,220,610 | A | 9/1980 | Dursch | |
| 4,223,003 | A | 9/1980 | Scheller | |
| 4,229,410 | A | 10/1980 | Kosti | |
| 4,246,717 | A * | 1/1981 | Wachtel | 446/19 |
| 4,248,597 | A | 2/1981 | McNeely | |
| 4,301,141 | A | 11/1981 | Scheller | |
| 4,321,251 | A | 3/1982 | Mashberg | |
| 4,359,455 | A | 11/1982 | Nakamura et al. | |
| 4,397,944 | A | 8/1983 | Komura et al. | |
| 4,431,628 | A | 2/1984 | Gaffar | |
| 4,436,725 | A | 3/1984 | Endo | |
| 4,441,928 | A | 4/1984 | Iijima | |
| 4,511,497 | A * | 4/1985 | Ehrlich | 516/14 |
| 4,568,534 | A | 2/1986 | Stier et al. | |
| 4,592,908 | A | 6/1986 | Wajaroff et al. | |
| 4,749,508 | A | 6/1988 | Cockrell, Jr. et al. | |
| 4,793,988 | A | 12/1988 | Casey et al. | |
| 4,839,278 | A | 6/1989 | Terashima et al. | |
| 4,876,082 | A | 10/1989 | Romeo | |
| 4,877,459 | A | 10/1989 | Cockrell et al. | |
| 4,889,559 | A | 12/1989 | Goldberg et al. | |
| 4,900,665 | A | 2/1990 | Terashima et al. | |
| 4,906,395 | A | 3/1990 | Stoesser et al. | |
| 4,921,636 | A | 5/1990 | Traas | |
| 4,954,544 | A | 9/1990 | Chandaria | |
| 4,965,063 | A | 10/1990 | Casey et al. | |
| 5,015,467 | A | 5/1991 | Smitherman | |
| 5,032,178 | A | 7/1991 | Cornell | |
| 5,053,339 | A | 10/1991 | Patel | |
| 5,055,287 | A | 10/1991 | Kessler | |
| 5,057,303 | A | 10/1991 | Casey | |
| 5,064,635 | A | 11/1991 | Casey | |
| 5,082,386 | A | 1/1992 | Hironaka et al. | |
| 5,110,492 | A | 5/1992 | Casey | |
| 5,124,129 | A | 6/1992 | Riccitelli et al. | |

(Continued)

FOREIGN PATENT DOCUMENTS

| | | |
|---|---|---|
| CN | 1077884 | 11/1993 |

(Continued)

OTHER PUBLICATIONS

"Estimation of dental plaque levels and gingival inflammation using a simple oral rinse technique", by Tal H. Rosenberg M., PMID 2366142, *J Periodontol*, Jun. 1990; 61(6): 339-42.

"Oratest:—a simple, chair-side caries activity test", by Pataley A., Shubhada C., Nadiger SL, PMID 9522746; *J Indian Soc Pedod Prev Dent*, Mar. 1996; 14(1):6-9.

Anonymous: "colored bubbles", www.geocities.com/bislz/index.html> XP002404490.

Anonymous: "How to make Colored Soap Bubbles", http://chemistry.about.com/od/chemistryhowtoguide/ht/colorbubble.htm> XP 002404491.

European Examination Report of Jul. 18, 2008.

*Primary Examiner* — Milton I Cano
*Assistant Examiner* — M. Reza Asdjodi
(74) *Attorney, Agent, or Firm* — Colin L. Fairman; Scott D. Rothenberger; Fulbright & Jaworski

(57) ABSTRACT

Compositions and methods for producing colored bubbles, having a single color uniformly dispersed in the film, are described. The composition comprises at least one surfactant mixed with at least one colorant, the colorant forming at least approximately 10% of the composition. The surfactant, or surface-active agent, forms the bubble while the colorant, or pigment, provides the color. Generally, the composition may comprise 10-99% colorant to produce varying degrees of opacity. In addition, glycerin, fragrance, propylene glycol, sodium lauryl sulfate, potassium hydroxide, or other additives may be included.

33 Claims, 5 Drawing Sheets
(5 of 5 Drawing Sheet(s) Filed in Color)

U.S. PATENT DOCUMENTS 5,143,023 A 9/1992 Kuhns
5,143,729 A 9/1992 Thompson
5,154,917 A 10/1992 Ibrahim et al.
5,160,371 A 11/1992 Ito
5,167,952 A 12/1992 McHugh et al.
5,192,332 A 3/1993 Lang et al.
5,196,243 A 3/1993 Kawashima
5,223,245 A 6/1993 Ibrahim et al.
5,246,631 A * 9/1993 Halbritter ..... 252/700
5,270,174 A 12/1993 Rosenberg
5,346,422 A 9/1994 Bagrodia et al.
5,372,801 A 12/1994 Malmros et al.
5,407,665 A 4/1995 McLaughlin et al.
5,409,977 A 4/1995 Sitaramiah et al.
5,418,013 A 5/1995 Detrick et al.
5,464,470 A 11/1995 Brachman et al.
5,480,925 A 1/1996 Masuzaki et al.
5,482,634 A 1/1996 Goerlach-Doht et al.
5,482,654 A 1/1996 Luttrell et al.
5,486,228 A 1/1996 Miller et al.
5,523,075 A 6/1996 Fuerst et al.
5,527,489 A 6/1996 Tadsen et al.
5,532,029 A 7/1996 Fuerst et al.
5,565,363 A 10/1996 Iwata et al.
5,567,420 A 10/1996 McEleney et al.
5,595,062 A 1/1997 Chabry
5,599,525 A 2/1997 Hsu et al.
5,664,947 A * 9/1997 Dietterich et al. ..... 434/84
5,680,962 A 10/1997 McEleney et al.
5,690,913 A 11/1997 Hsu et al.
5,753,210 A 5/1998 McEleney et al.
5,753,244 A 5/1998 Reynolds et al.
5,837,645 A 11/1998 Fuerst et al.
5,853,430 A 12/1998 Shindo et al.
5,882,627 A 3/1999 Pomerantz
5,885,594 A 3/1999 Nilsen et al.
5,929,004 A 7/1999 Ushijima et al.
5,942,438 A 8/1999 Antonoplos et al.
5,948,631 A 9/1999 Nagel et al.
5,955,062 A 9/1999 Mceleney et al.
5,958,383 A 9/1999 Mceleney et al.
5,968,241 A 10/1999 Santini et al.
5,972,869 A 10/1999 Cao et al.
5,990,074 A 11/1999 Gross et al.
5,997,891 A 12/1999 Fuerst
6,002,056 A 12/1999 Smith et al.
6,030,222 A 2/2000 Tarver
6,036,493 A 3/2000 Sharma
6,039,797 A 3/2000 Fistner, Sr.
6,042,813 A 3/2000 Fowler
6,056,810 A 5/2000 Lugert
6,066,689 A 5/2000 Columbus et al.
6,086,858 A 7/2000 McEleney et al.
6,099,825 A 8/2000 McShane et al.
6,100,226 A 8/2000 Konzman et al.
6,124,377 A 9/2000 Kaiser et al.
6,126,923 A 10/2000 Burke et al.
6,139,821 A 10/2000 Fuerst et al.
6,149,895 A 11/2000 Kutsch
6,152,887 A 11/2000 Blume
6,160,034 A 12/2000 Allison et al.
6,331,515 B1 12/2001 Gambogi et al.
6,365,134 B1 4/2002 Orlowski et al.
6,375,934 B1 4/2002 Eklund et al.
6,395,551 B1 5/2002 Kipke et al.
6,413,502 B1 7/2002 Bornstein et al.
6,419,902 B1 7/2002 Wright
6,447,757 B1 9/2002 Orlowski et al.
6,501,002 B1 12/2002 Roe et al.
6,531,118 B1 3/2003 Gonzalez et al.
6,531,528 B1 3/2003 Kurp
6,562,771 B2 5/2003 Finch et al.
6,576,633 B1 6/2003 Young et al.
6,607,744 B1 8/2003 Ribi
6,663,902 B1 12/2003 Hei et al.
6,667,161 B1 12/2003 Johnson et al.
6,677,129 B1 1/2004 Blume
6,677,287 B1 1/2004 Willman et al.
6,722,708 B2 4/2004 Morohoshi et al.
6,726,584 B2 4/2004 Iggulden
6,733,766 B2 5/2004 Gott et al.
6,783,991 B1 8/2004 Mehta et al.
6,814,816 B2 11/2004 Achar et al.
6,846,512 B2 1/2005 Rohrbaugh et al.
6,866,863 B2 3/2005 Ribi
6,869,028 B2 3/2005 Bartsch et al.
6,869,452 B2 3/2005 Hopkinson et al.
6,894,095 B2 5/2005 Russo et al.
6,904,865 B2 6/2005 Klofta et al.
6,938,757 B2 9/2005 Eastman et al.
6,960,475 B2 11/2005 Ling et al.
6,962,745 B2 11/2005 Penneau et al.
6,965,043 B1 11/2005 Kenneally et al.
6,998,113 B1 2/2006 Traynor et al.
2002/0004942 A1 * 1/2002 Bryan ..... 800/288
2002/0034475 A1 3/2002 Ribi
2002/0038064 A1 3/2002 Asgaonkar
2002/0077386 A1 * 6/2002 Kurabayashi et al. ..... 523/161
2002/0156094 A1 10/2002 Albrecht et al.
2002/0160224 A1 11/2002 Gabbianelli et al.
2002/0195413 A1 12/2002 Eastman et al.
2002/0197214 A1 12/2002 Bublewitz et al.
2003/0044360 A1 3/2003 Orlowski et al.
2003/0099685 A1 5/2003 Ashkar et al.
2003/0103905 A1 6/2003 Ribi
2003/0109392 A1 * 6/2003 Smith ..... 510/130
2003/0109537 A1 6/2003 Turner et al.
2003/0113266 A1 6/2003 Matsumoto
2003/0164136 A1 9/2003 Klofta et al.
2003/0191036 A1 10/2003 MacDonald et al.
2003/0211618 A1 11/2003 Patel
2003/0220213 A1 11/2003 Bober
2003/0224298 A1 12/2003 Kobayashi et al.
2004/0014875 A1 1/2004 Russo et al.
2004/0026664 A1 2/2004 Lin
2004/0028624 A1 2/2004 Bublewitz et al.
2004/0053803 A1 3/2004 Lye et al.
2004/0065350 A1 4/2004 Achar et al.
2004/0087922 A1 5/2004 Bobadilla
2004/0175405 A1 9/2004 Mahgoub et al.
2004/0213698 A1 10/2004 Tennakoon et al.
2004/0247557 A1 12/2004 Veeger et al.
2005/0049157 A1 3/2005 MacDonald et al.
2005/0065048 A1 3/2005 MacDonald et al.
2005/0075419 A1 4/2005 Kwan et al.
2005/0090414 A1 4/2005 Rich
2005/0093948 A1 5/2005 Morris et al.
2005/0103233 A1 5/2005 Rood
2005/0112025 A1 5/2005 Takahashi et al.
2005/0112085 A1 5/2005 MacDonald et al.
2005/0136548 A1 6/2005 McDevitt et al.
2005/0139608 A1 6/2005 Muehlhausen et al.
2005/0140923 A1 6/2005 Fishbaugh
2005/0142063 A1 6/2005 Batich
2005/0143505 A1 6/2005 Rosekelly et al.
2005/0163729 A1 7/2005 Zaidel et al.
2005/0166797 A1 8/2005 Li et al.
2005/0187137 A1 8/2005 Pegelow et al.
2005/0191326 A1 9/2005 Melker
2005/0199177 A1 9/2005 Klofta et al.
2005/0233918 A1 10/2005 Rich
2005/0233919 A1 10/2005 Rich
2005/0276769 A1 12/2005 Herrlien et al.
2006/0008912 A1 1/2006 Simon et al.

FOREIGN PATENT DOCUMENTS

DE 1767662 2/1972
DE 1767662 B 6/1975
DE 10254337 11/2003
EP 0 155 737 9/1985
EP 0218732 4/1987
EP 0 549 145 A1 6/1993
EP 1 457 529 9/2004
EP 1 649 910 4/2006
FR 1499925 11/1967
FR 2591102 6/1987
GB 23463 10/1905

| | | | |
|---|---|---|---|
| GB | 29565 | | 2/1911 |
| GB | 2 086 407 | A | 5/1982 |
| JP | 49001737 | | 1/1974 |
| JP | 49066837 | | 6/1974 |
| JP | 49066839 | | 6/1974 |
| JP | 49071151 | | 7/1974 |
| JP | 55-027200 | | 2/1980 |
| JP | 56-058663 | | 5/1981 |
| JP | 56100384 | | 8/1981 |
| JP | 57-175129 | | 10/1982 |
| JP | 60016913 | | 1/1985 |
| JP | 60075409 | | 4/1985 |
| JP | 60170674 | | 9/1985 |
| JP | 62045672 | | 2/1987 |
| JP | 62207370 | | 9/1987 |
| JP | 04-257512 | | 9/1992 |
| JP | 09-175970 | | 7/1997 |
| JP | 2000-053548 | | 2/2000 |
| JP | 2002-256291 | | 9/2002 |
| JP | 2005-008537 | | 3/2005 |
| KR | 2002056224 | | 7/2002 |
| KR | 2004060382 | | 7/2004 |
| NL | 6807888 | | 12/1968 |
| WO | WO 90/05529 | | 5/1990 |
| WO | WO 95/33387 | | 12/1995 |
| WO | WO 96/29047 | | 9/1996 |
| WO | WO 97/26076 | | 7/1997 |
| WO | WO 97/43012 | | 11/1997 |
| WO | WO 99/59496 | | 11/1999 |
| WO | WO 02/098349 | | 12/2002 |
| WO | WO 03/000215 | | 1/2003 |
| WO | WO 2004/052307 | | 12/2003 |
| WO | WO 2004/043418 | | 5/2004 |
| WO | WO 2005/074863 | | 8/2005 |
| WO | WO 2005/084434 | A2 | 9/2005 |
| WO | WO 2005/094767 | | 10/2005 |
| WO | WO 2005/123023 | | 12/2005 |
| WO | WO 2006/009798 | | 1/2006 |

* cited by examiner

COMPOSITION AND METHOD FOR PRODUCING COLORED BUBBLES

CROSS REFERENCE TO RELATED APPLICATIONS

This application claims benefit under 35 U.S.C. §119(e) to application Ser. No. 60/581,294, filed on Jun. 17, 2004, by Tim Kehoe entitled "Composition and Method for Producing Colored Bubbles the contents of which are incorporated herein by reference in their entirety for all purposes.

FIELD OF THE INVENTION

This invention relates generally to colored bubbles, and more specifically to a composition and method for producing substantially uniformly colored bubbles. The compositions are non-toxic and, if necessary, are washable.

BACKGROUND OF THE INVENTION

Bubbles have long fascinated children, adults, and scientists alike. The formation of bubbles for recreation and entertainment is a well-recognized and widely practiced past-time. In its simplest form, bubble blowing involves dipping a shaped article having an opening into a liquid soap solution followed by blowing into the opening to form one or more bubbles. A bubble is generally defined as a small volume of gas contained within a thin liquid spherical envelop. A wand, for example, is generally immersed into a bubble solution and air is blown through spherical opening to generate bubbles. Surface tension causes the bubble solution to for a film across the opening. Upon application of a sufficient force or pressure upon one side of the film, a bubble is formed and expelled from the opening.

A variety of bubble solutions have been marketed over the years, many of them claiming to have special features like longer lasting bubbles, solutions that produce greater numbers of bubbles, or solution that provide bubbles having a colorful in appearance. Some manufacturers adorn their bubble packaging with illustrations of colored bubbles, or add colorants to tint their bubble solution, in an effort to provoke the illusion of a colored bubble. Some manufactures have added modifying agents like glycerin to produce a transparent bubble with a transparent iridescent rainbow effect. One manufacturer added color directly to the bubble and/or the bubble solution in an effort to create designs on a piece of paper with what they labeled a colored bubble. This composition of liquid solution does not produce a visually colored bubble, but rather a bubble that is used as a vehicle to transport the color to the marking surface. The bubble wall is transparent and does not produce a uniformly colored bubble. Rather the color runs to the bottom of the bubble wall. Others manufacturers claim to produce bubble that is illuminated when viewed in the dark with infrared radiation or black light, but transparent in regular light.

Therefore, a need exists for the development of a solution, and a resultant bubble, that provides a substantially uniform color.

BRIEF SUMMARY OF THE INVENTION

The present invention surprisingly provides colored bubble compositions, that have a uniform coloration about the bubble.

The compositions of the present invention can also be used in, but not limited to, other fields such as toys, toothpaste, bath bubbles, shampoo, soaps, creams, lotions, diapers, lenses, paint, inks, adhesives, displays, semiconductors, biomedical, photonics, face masks, hair colors, plastics, and textiles.

In one embodiment, the present invention provides an aqueous composition that includes a surfactant and a colorant. The compositions provide a bubble that is a uniformly colored bubble. Suitable colorants include dyes, polymeric dyes, fluorescent dyes, pigments, and/or colorants. The compositions are non-toxic and/or washable, if necessary.

In one aspect, the substantially uniformly colored bubble includes a surfactant that is a polyether, an alkyl metal sulfate, a betaine, an alkanolamide or a combination thereof. In one embodiment, the polyether surfactant is a cellulose ether surfactant. In another embodiment, the alkyl metal sulfate is sodium lauryl sulfate.

In another aspect, the substantially uniformly colored bubble includes a surfactant that is a combination of a polyether surfactant and an alkyl metal sulfate.

In still another aspect, the substantially uniformly colored bubble includes a polyether surfactant that is a cellulose ether surfactant and the alkyl metal sulfate is sodium lauryl sulfate.

In still yet another aspect, the substantially uniformly colored bubble includes a surfactant that is a combination of an alkyl metal sulfate, a betaine and an alkanolamide.

In still another embodiment, the present invention provides methods to prepare compositions that provide the various bubble producing solutions used throughout the present specification.

In one aspect, the method to prepare a solution for a substantially uniformly colored bubble solution includes the steps of heating a mixture of glycerin, colorant and water to a temperature between about 50° C. and about 60° C., followed by cooling the mixture and then adding a surfactant to the cooled mixture. Generally the solution is cooled to room temperature prior to the addition of the surfactant. Typical colorants include acid dyes, FD&C dyes, food dyes, polymeric dyes, fluorescent dyes, pigments, or combinations thereof.

In particular, the surfactant is a polyether, an alkyl metal sulfate, or a combination thereof. Suitable polyether surfactants include cellulosic polyethers and suitable alkyl metal sulfates include lauryl sulfates having a metal counterion.

In another aspect, methods to prepare a solution for a substantially uniformly colored bubble solution include combining glycerin, colorant, water, an alkanolamide and an alkyl metal sulfate to form a mixture. The mixture is then heated to a temperature below about 60° C. and is then cooled to room temperature. Typical colorants include acid dyes, FD&C dyes, food dyes, polymeric dyes, fluorescent dyes, pigments, or combinations thereof.

In still yet another embodiment, the present invention provides kits that include the compositions of the invention and instructions how to prepare bubbles from the compositions.

While multiple embodiments are disclosed, still other embodiments of the present invention will become apparent to those skilled in the art from the following detailed description. As will be apparent, the invention is capable of modifications in various obvious aspects, all without departing from the spirit and scope of the present invention. Accordingly, the detailed descriptions are to be regarded as illustrative in nature and not restrictive.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION

Figure 1A:
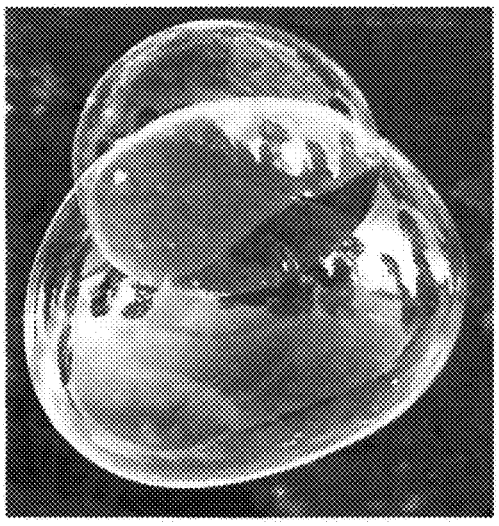
FIG. 1*a* is an exemplary substantially uniformly colored bubble prepared by a composition and method of the present invention.

Prior to the present invention, it was generally considered extremely difficult if not impossible to make a colored bubble with uniform color intensity throughout the bubble: A bubble's wall is only a few millionths of an inch thick and up until the present invention it was considered that the bubble wall was incapable of being colored.

Traditionally, when a light waves hits the surface of a bubble, part of the light is reflected back to a viewer's eye from the outer surface and part of the light is reflected from the inner surface which is a few millionths of an inch further. As the two waves of light travel back, they interfere with one another causing what we visualize as color. When the waves reinforce each other, the color is more intense. When the waves get close to canceling each other out, there is almost no color. As a bubble wall gets thinner, either from a weakened solution or because gravity has pulled the additives to the bottom of the bubble, the distance between the inner surface and the outer surface of the bubble becomes less and less until the two reflected waves of light start to coincide and cancel each other out. The result is that the bubble loses its color and can become nearly invisible.

Prior to the present invention, it has proven extremely difficult, if not impossible, to develop a colored bubble composition with uniform color intensity throughout the bubble. When the dyes are added to the soap/bubble solution, they form colored solution but when the bubbles are blown, the resulting bubbles are colorless.

The present invention surprisingly provides bubble compositions that have substantially uniform coloration about the bubble. The bubbles can have a wide range of opacity, colors and scents. The compositions and resultant bubbles are non-toxic and/or washable.

The present invention further provides compositions and methods for producing bubbles, as described herein, having a wide range of opacities, ranging from essentially translucent to semi-transparent to opaque. The bubbles can be intrinsically colored; the composition from which the bubbles are formed itself is colored.

In some embodiments, the bubbles have substantially uniform color intensity. In other embodiments, the bubbles can have non-uniform color intensity and/or dispersion.

The phrases "substantially uniform" or "substantially uniformly" are intended to refer to coloration about the bubble such that the coloration intensity is approximately equal from the top of the bubble to the bottom of the bubble. In such an embodiment, the coloration in the bubble is dispersed evenly throughout the bubble and coloration streaking or having an increased concentration of color at the bottom of the bubble is substantially avoided. It should be understood that the coloration throughout the bubble can be such that a swirling pattern, random or non-random, can be seen on the surface of the bubble's film, but yet not having an increased concentration of color at the bottom of the bubble. For example, the substantially uniform color could be considered "solid" (See FIG. 1) or could have a swirled aspect as in FIG. 2.

The phrases "non-uniform" or "non-uniformly" are intended to refer to coloration about the bubble such that the coloration intensity is concentrated, for example, more at the top and bottom of the bubble. Such fanciful bubbles can be very interesting to children.

The phrase "colored bubble" is intended to refer to a bubble that can be uniformly or non-uniformly colored, as described herein, but does not have a change in coloration over a given period of time and does not have the coloration disappear from the bubble. Colored bubbles retain their coloration throughout the period of time the bubble exists, generally from about a few seconds to about a few minutes.

The aqueous solutions of the present invention generally contain between about 1 and about 90 parts water, in particular between about 10 and about 80, and more particularly between about 20 and about 70 percent based on a total weight percentage of the final composition. In one aspect, the water utilized can be ordinary tap water or spring water. In another aspect the water can be deionized water or water purified by reverse osmosis.

The compositions of the invention include a surfactant. Suitable surfactants include anionic, cationic, nonionic or zwitterionic compounds and combinations thereof. The surfactant can be either polymeric or non-polymeric.

The term "surfactant" is recognized in the relevant art to include those compounds which modify the nature of surfaces, e.g. reducing the surface tension of water. Surfactants are generally classified into four types: cationic (e.g. modified onium salts, where part of the molecule is hydrophilic and the other consists of straight or branches long hydrocarbon chains such as hexadecyltrimethyl bromide), anionic, also known as amphiphatic agents (e.g., alkyl or aryl or alkylaryl-sulfonates, carboxylates, phosphates), nonionic (e.g., polyethylene oxides, alcohols) and ampholytic or amphoteric (e.g. dodecyl-beta-alanine, such that the surfactant contains a zwitterionic group). One or more surfactants can be used in the present invention.

Cationic surfactants useful as surface tension reducing agents in the present invention include long chain hydrocarbons which contain quaternarized heteroatoms, such as nitrogen. Suitable cationic surfactants include quaternary ammonium compounds in which typically one of the groups linked to the nitrogen atom is a C12-C18 alkyl group and the other three groups are short chained alkyl groups.

Anionic surfactants (amphiphatic agents) are characterized by a single lipophilic chain and a polar head group which can include sulfate, sulfonate, phosphate, phosphonate and carboxylate. Exemplary compounds include linear sodium alkyl benzene sulfonate (LAS), linear alkyl sulfates and phosphates, such as sodium lauryl sulfate (SLS) and linear alkyl ethoxy sulfates. Additional examples of anionic surfactants include substituted ammonium (e.g., mono-, di-, and tri-ethanolammonium), alkali metal and alkaline earth metal salts of C6-C20 fatty acids and rosin acids, linear and branched alkyl benzene sulfonates, alkyl ether sulfates, alkane sulfonates, olefin sulfonates, hydroxyalkane sulfonates, fatty acid monoglyceride sulfates, alkyl glyceryl ether sulfates, acyl sarcosinates. acyl N-methyltaurides, and alkylaryl sulfonated surfactants, such as alkylbenzene sulfonates.

Nonionic surfactants do not dissociate but commonly derive their hydrophilic portion from polyhydroxy or polyalkyloxy structures. Suitable examples of polyhydroxy (polyhydric) compounds include ethylene glycol, butylene glycol, 1,3-butylene glycol, propylene glycol, glycerine, 2-methyl-1,3-propane diol, glycerol, mannitol, corn syrup, beta-cyclodextrin, and amylodextrin. Suitable examples of polyalkyloxy compounds include diethylene glycol, dipropylene glycol, polyethylene glycols, polypropylene glycols and glycol derivatives.

Other suitable nonionic surfactants include other linear ethoxylated alcohols with an average length of 6 to 16 carbon atoms and averaging about 2 to 20 moles of ethylene oxide per mole of alcohol; linear and branched, primary and secondary ethoxylated, propoxylated alcohols with an average length of about 6 to 16 carbon atoms and averaging 0-10 moles of ethylene oxide and about 1 to 10 moles of propylene oxide per mole of alcohol; linear and branched alkylphenoxy (polyethoxy) alcohols, otherwise known as ethoxylated alkylphenols, with an average chain length of 8 to 16 carbon atoms and averaging 1.5 to 30 moles of ethylene oxide per mole of alcohol; and mixtures thereof.

Additionally, suitable nonionic surfactants include polyoxyethylene carboxylic acid esters, fatty acid glycerol esters, fatty acid and ethoxylated fatty acid alkanolamides. Block copolymers of propylene oxide and ethylene oxide, and block polymers of propylene oxide and ethylene oxide with propoxylated ethylene diamine are also included as acceptable nonionic surfactants. Semi-polar nonionic surfactants like amine oxides, phosphine oxides, sulfoxides, and their ethoxylated derivatives are included within the scope of the invention.

Suitable amphoteric and zwitterionic surfactants which contain an anionic water-solubilizing group, a cationic group and a hydrophobic organic group include amino carboxylic acids and their salts, amino dicarboxylic acids and their salts, alkylbetaines, alkyl aminopropylbetaines, sulfobetaines, alkyl imidazolinium derivatives, certain quaternary ammonium compounds, certain quaternary phosphonium compounds and certain tertiary sulfonium compounds Examples of anionic, nonionic, cationic and amphoteric surfactants that are suitable for use in the present invention are described in Kirk-Othmer, Encyclopedia of Chemical Technology, Third Edition, Volume 22, pages 347-387, and McCutcheon's Detergents and Emulsifiers, North American Edition, 1983, both of which are incorporated herein by reference.

Typical concentration ranges of surfactant that are useful in the present compositions are from about 0.01 parts by weight to about 90 parts by weight, from about 0.5 part by weight to about 50 parts by weight, and from about 1 parts by weight to about 10 parts by weight.

In one aspect, surfactants useful in the compositions of the invention include, but are not limited to, cellulose ethers or mixtures with other surfactants, which are water soluble. Cellulose ether surfactants have unique foaming and bubble forming properties which make them ideal of colored bubble applications. Cellulose ethers used in the present invention include methyl cellulose, ethyl cellulose, propyl cellulose, butyl cellulose, higher alkyl, aryl, alkoxy, cycloalkyl celluloses, hydroxypropyl cellulose, hydroxybutyl cellulose or mixtures thereof.

Commercial cellulose ether surfactants include, but are not limited to, Methocel A4M, methyl cellulose, Methocel F4M, hydroxypropyl methylcellulose, Methocel K4M, hydroxypropyl methylcellulose, manufactured by Dow Chemical Co., Mildland, Mich.; Natrosol, hydroxyethyl cellulose, Klucel, hydroxypropyl cellulose, Aqualon Cellulose Gum, sodium carboxymethyl cellulose, Hercules Inc., Wilmington, Del.; Elfacos CD 481, ethyl 2-hydroxyethyl ether cellulose, manufactured by Akzo Nobel, Chicago, Ill.

Cellulose ether surfactants are generally present in amounts from about 1% up to about 40% by weight in the compositions of the invention. Suitable concentrations of cellulose ether surfactants are in the range of about 2% to about 30% by weight and from about 3% to about 8% by weight. A particularly useful cellulosic ether surfactant in the compositions is Methocel A4M.

In another aspect, alkanolamide or a mixture with other surfactants can be used in the compositions of the invention. Alkanolamides are commercially available and are the reaction products of one or more fatty acids having 12 or more carbon atoms and a lower alkanolamine. Typical alkanolamides are formed by reaction between stearic, mystiric, lauric acid or mixtures thereof with mono-, di-, and/or iso-propanolamine.

Alkanolamides can be present in the compositions of the invention in the ranges generally described throughout the application but generally are present in amounts from about 0% up to about 10% by weight. Suitable ranges include from about 1% to about 6% by weight and in particular from about 1.5% to about 4% by weight.

In one embodiment, the alkanolamide surfactants of the present invention include, but are not limited to, Ninol 55LL, diethanolamine, Ninol 40CO, cocamide DEA, Ninol 30LL, lauramide DEA, manufactured by Stepan Co., Northfield, Ill.; Colamid C, cocamide DEA, Colamid 0071-J, alkanolamide, manufactured by Colonial Chemical Inc., S. Pittsburgh, Tenn. In one aspect, the alkanolamides are Ninol 55LL, and Colamid C.

Exemplary sulfosuccinates that can be employed in the present compositions include, but are not limited to, Stepan-Mild SL3-BA, disodium laureth sulfosuccinate, Stepan-Mild LSB, sodium lauryl sulfosuccinate, manufactured by Stepan Co., Northfield, Ill., Lankropol 4161L, sodium fatty alkanolamide sulfosuccinate and Colamate-DSLS, disodium laureth sulfosuccinate, manufactured by Colonial Chemical Inc., S. Pittsburgh, Tenn.

Suitable betaines that can be employed in the present compositions include, but are not limited to, Miracare BC-27, cocamidopropyl betaine and Miranol Ultra C-37, sodium cocoampho acetate, manufactured by J & S Chemical Co., Weston, Fla.

Suitable sulfates that can be employed in the present compositions include Rhodapex ES-2, sodium laureth sulfate, J & S Chemical Co., Weston, Fla.; Witcolate WAQ, sodium alkyl sulfate, manufactured by Akzo Nobel, Chicago, I and Colonial-SLS, sodium lauryl sulfate, manufactured by Colonial Chemical Inc., S. Pittsburgh, Tenn.

A suitable nonionic surfactant that can be employed in the present compositions is Triton H-66, alkyl aryl alkoxy potassium salt, manufactured by Dow Chemical Co., Mildland, Mich.

In one particular embodiment, the surfactant used is a combination of an ether based surfactant, such as a cellulose ether surfactant and an sodium alkyl sulfate, such as sodium lauryl sulfate.

In a particular embodiment, the surfactant is a combination of Methocel A4M (4 weight percent in aqueous solution) and sodium lauryl sulfate (30 weight percent in aqueous solution) in a (1:1 ratio) with a concentration range of from about 1 part by weight to about 10 parts by weight of the total weight of the composition. In particular aspects, the total weight of the ether surfactant and the alkyl sulfate surfactant of the total weight of the composition is between about 3 percent and about 8 percent by weight, more particularly between about 3 percent and about 5 percent by weight, and in particular about 5 percent by weight.

In another embodiment, the surfactant used is a combination of an alkanolamide and a mixture of an alkyl betaine and/or an alkyl sulfonate.

In a particular embodiment, the surfactant is a combination of Colamid C and Miracare B C27 which is a mixture of Surfactant blend include sodium trideceyl sulfate, water, PEG 80 sorbitant laurate, cocamidopropyl betaine, sodium lauroamphoacetate, PEG 150 distearate, sodium laureth-13 carboxylate, glycerin, citric acid, tetrasodium EDTA, quaternium-15. Generally, the combination of the alkanolamide and alkylsulfonate/betaine is in the range of between about 1:1 to about 1:7, more particularly between about 1:1 to about 2:7 and more particularly about 2:7. Generally, the combination of the two surfactants comprises a concentration between about 3 and about 10 percent by weight of the total weight of the composition, and more particularly between about 5 and about 10 percent by weight of the total weight of the composition, and in particular about 9 percent of the total weight of the composition.

The aqueous compositions of the invention can further include a solvent or other additives as described throughout the present application. Suitable solvents include, for example, alcohols having a carbon chain length of from about 1 carbon atom to about 12 carbon atoms. Typically, methanol and ethanol are not included due to their generally recognized properties, especially in view of use with children.

Suitable optional additives to the compositions of the invention include, humectants, preservatives, fragrance, dye blockers, cleaners, etc.

The term "humectant" is known and helps to retard the evaporation of water from the composition of the invention, thus avoiding premature drying during the application. Not to be limited by theory, it is believed that the presence of a humectant helps to strengthen the bubble formation, enhances even distribution of the dye throughout the bubble and increases life of bubble in the air.

Representative examples of humectants include, but are not limited to, polyhydroxy alkyls, such as glycerin, ethylene glycol, propylene glycol, diethylene glycol, polyethylene glycol, hydroxylated starches and mixtures of these materials. Any effective amount of humectant may be used although a generally useful concentration range for these humectants is from about 5% to about 35% by weight of the total composition. Particular ranges of the humectant include a range of from about 8% to about 30% by weight of the composition and from about 10% to about 25% by weight of the composition. In one particular aspect, the humectant is glycerin.

Not to be limited by theory, it is believed that in some application glycerin helps to evenly distribute the colorant within the bubble film.

Representative examples of preservatives include, but are not limited to, glutaraldehyde, bicyclic oxazolidones, hydroxybenzoic acid esters, 3-iodo-2-propynyl butyl carbamate, methyl p-hydroxybenzoate, and a biocide comprising 2-methyl-4-isothiazolin-3-one and 5-chloro-2-methyl-4-isothiazolin-3-one. The preservatives often serves as both a bactericide and a fungicide.

In particular, compositions of the invention include preservatives that are selected from, but not limited to, Liquid Germall Plus, iodopropynyl butyl carbamate, Germall II, diazolidinyl urea, Nuosept 95, bicyclic oxazolidines solution, manufactured by ISP (International Specialty Products), Wayne, N.J., Troysan 395, dihydroxy-dimethyl hydantoin, manufactured by Troy Chemical Corporation, Florham park, N.J. and Kathon PFM, isothiazolinones, manufactured by Rohm & Haas Co., Philadelphia, Pa.

Preservatives, when present in the compositions of the invention, are generally present in amounts from about 0.01% to about 6% by weight, in particular from about 0.05% to about 5% by weight, and particularly from about 0.1% to about 2.5% by weight. In one aspect, the preservative is one of Liquid Germall Plus, Tryosan 395 or Nuosept 95.

Representative fragrances include those pleasing to children such as flowers, candy, popcorn, fruit, bubble gum and the like. A fragrance, when present in the compositions of the invention, is generally present in amounts from about 0.1% to about 10% by weight of the total weight of the composition.

Dye blockers or cleaners can be optionally added in the compositions of the invention to remove dye from hard/porous surfaces such as wood, stone, brick, leather, cloth, concrete, skin, fabric, etc. Up until the present invention, contact with a solution having a dye could stain a surface.

Suitable dye blockers include, but are not limited to, Bio-Terge PAS-8S, sodium octane sulfonate, Stepanate SXS, sodium xylenesulfonate, Steposol DG, fatty alcohol ethoxylate, manufactured by Stepan Co., Northfield, Ill., Dowfax 8390, disodium hexadecyldiphenyloxide disulfonate, Dowfax 2A1, benzene-1,1-oxybis-tetrapropylene sulfonated sodium, Dowfax 3B2, decyl-sulfophenoxy-benzenesulfonic acid-disodium, Dowfax C10L, decyl-sulfophenoxybenzenesulfonicacid disodium, Triton X-15, octylphenoxypolyethoxyethanol, manufactured by Dow Chemical Co., Mildland, Mich., Tamol SN, sodium salt of naphthalene-formaldehyde condensate, Tamol 731, sodium salt of carboxylated polyelectrolyte, manufactured by Rohm & Haas Co., Philadelphia, Pa., Darvan 2, sodium lignin sulfonate, manufactured by R. T. Vanderbilt & Co., Norwalk, Conn., Aqua-Cleen GP, polyethoxylated tert-dodecyl sulfur compound, TZ-Paint Prep, phosphorous/sulfur containing builders, and TAZ-B300, sulfur/oxygen/nitrogen containing surface active agents, manufactured by Chemical Products Industries, Oklahoma City, Okla.

Dye blockers or cleaners are usually effective in the compositions of the invention when present in any amount but generally are present in ranges from about 5% up to about 50% by weight, from 10% to about 40% by weight or from about 12% to about 25% by weight.

Suitable colorants can be selected from various dye/pigments classes that include, but are not limited to acid dyes, food dyes (FD&C)/cosmetic dyes (D & C), polymeric dyes, fluorescent dyes and pigments Suitable dyes can be selected from various dye classes that include, but are not limited to acid dyes, basic dyes, direct dyes, reactive dyes, sulfur dyes, fluorescent dyes, food dyes (FD&C) cosmetic dyes (D & C), solvent dyes and polymeric dyes.

The terms "acid dye" or "acidic dye" are recognized in the art and are intended to include those water soluble anionic dyes that are applied to a material from neutral to acid solution. Attachment to the material is attributed, at least partly, to salt formation between anionic groups in the dyes and cationic groups in the material. Generally, acid dyes have functional groups such as azo, triaryl methane or anthraquinone that include acid substituents such as nitro, carboxy or sulfonic acid groups.

Representative examples of acid dyes useful in the present compositions include, but are not limited to, Acid Black 1, Acid Black 2, Acid Black 24, Acid Black 48, Acid Blue 1, Acid Blue 7, Acid Blue 9, Acid Blue 25, Acid Blue 29, Acid Blue 40, Acid Blue 45, Acid Blue 74, Acid Blue 80, Acid Blue 83, Acid Blue 90, Acid Blue 92, Acid Blue 113, Acid Blue 120, Acid Blue 129, Acid Blue 147, Acid Green 1, Acid Green 3, Acid Green 5, Acid Green 25, Acid Green 27, Acid Green 50, Acid Orange 6, Acid Orange 7, Acid Orange 8, Acid Orange 10, Acid Orange 12, Acid Orange 51, Acid Orange 51, Acid Orange 63, Acid Orange 74, Acid Red 1, Acid Red 4, Acid Red 8, Acid Red 14, Acid Red 17, Acid Red 18, Acid Red 26, Acid Red 27, Acid Red 29, Acid Red 37, Acid Red 44, Acid Red 50, Acid Red 51, Acid Red 52, Acid Red 66, Acid Red 73, Acid Red 87, Acid Red 88, Acid Red 91, Acid Red 92, v Acid Red 94, Acid Red 97, Acid Red 103, Acid Red 114, Acid Red 150, Acid Red 151, Acid Red 183, Acid Violet 7, Acid Violet 9, Acid Violet 17, Acid Violet 19, Acid Yellow 1, Acid Yellow 3, Acid Yellow 9, Acid Yellow 11, Acid Yellow 17, Acid Yellow 23, Acid Yellow 25, Acid Yellow 29, Acid Yellow 34, Acid Yellow 36, Acid Yellow 42, Acid Yellow 54, Acid Yellow 73, Acid Yellow 76 and Acid Yellow 99.

The terms "base dye" or "basic dye" are recognized in the art and are intended to include those water soluble cationic dyes that are applied to a material from neutral to basic solution. Generally, basic dyes have functional groups such as sulfonium, oxonium, or quaternary ammonium functional groups. Attachment to the material is attributed, at least partly, to salt formation between cationic groups in the dyes and anionic groups in the material.

Representative examples of basic dyes useful in the present compositions include, but are not limited to, Basic Black 2, Basic Blue 3, Basic Blue 6, Basic Blue 7, Basic Blue 9, Basic Blue 11, Basic Blue 12, Basic Blue 16, Basic Blue 17, Basic Blue 24, Basic Blue 26, Basic Blue 41, Basic Blue 66, Basic Blue 140, Basic Brown 1, Basic Brown 4, Basic fuchsin, Basic Green 1, Basic Green 4, Basic Green 5, Basic Orange 2, Basic Orange 14, Basic Orange 21, Basic Red 1, Basic Red 2, Basic Red 5, Basic Red 9, Basic Red 29, Basic Violet 1, Basic Violet 2, Basic Violet 3, Basic Violet 4, Basic Violet 10, Basic Yellow 1 and Basic Yellow 2.

The term "direct dye" is recognized in the art and is intended to include those water soluble dyes that adsorb onto a material. Bonding is believed to occur through hydrogen bonding and/or Van der Waals forces between the dye and the substrate.

Representative examples of direct dyes useful in the present compositions include, but are not limited to, Direct Blue 1, Direct Blue 14, Direct Blue 53, Direct Blue 71, Direct Red 2, Direct Red 23, Direct Red 28, Direct Red 75, Direct Red 80, Direct Red 81, Direct Violet 51, Direct Yellow 4, Direct Yellow 7, Direct Yellow 8, Direct Yellow 9, Direct Yellow 12, Direct Yellow 27, Direct Yellow 50, Direct Yellow 59, Direct Yellow 62.

The term "reactive dye" is recognized in the art and is intended to include those dyes that contain a reactive group, for example, either a haloheterocycle or an activated double bond, that, when applied to a surface in a weakly alkaline solution, forms a chemical bond with a hydroxyl or amino group on the substrate.

Representative examples of reactive dye compounds useful in the present compositions include, but are not limited to, Procion red, blue, orange and yellow (ICI), Levafix E Yellow (Bayer), Remazol Yellow (Hoechst), Cibacron (Ciba), Drimarene X, R, K (Sandoz), Reactive Black 5, Reactive Blue 2, Reactive Blue 4, Reactive Blue 13, Reactive orange 16 and Reactive Yellow 4.

The term "sulfur dye" is recognized in the art and is intended to include those dyes that contain sulfide linkages and are absorbed by a substrate and are insolubilised within or on the substrate by oxidation. During this process the sulfur dye forms complex larger molecules which are the basis of their good wash-fastness.

Representative examples of sulfur dyes useful in the present compositions include, but are not limited to, Sulfur Black 1 (Sulfur Black T) and Sulfur Blue (Patent Blue VF).

The term "fluorescent dye" is recognized in the art and is intended to include those dyes which give fluorescence either in solid phase or in liquid form. The color of compound can be different from the fluorescence in liquid form.

Representative examples of fluorescent dyes/pigments useful in the present compositions include, but are not limited to, Fluorescein, fluorescein diacetate, carboxyfluorescein, carboxyfluorescein diacetate, rhodamine B, sulforhodamine B, cotadecyl rhodamine B, rhodamine 6G, rhodamine 110, rhodaine 123, xanthene dyes, thioxanthene dyes, naphtholactam dyes, azlactone dyes, methane dyes, oxazine dyes, thiazine dyes, fluorol, coumarin, 7-N,N-dialkylamino-3-hetaryl-coumarin dyes, resorufin, quinoxalines, pyrido[1,2-a] benzimidazoles, acridine, acriflavin, acridine orange, nonyl acridine orange, xanthene, eosin Y, pyronine Y, texas red, calcein, quinacrine, ethidium bromide, propidium iodide, resazurin, nile, crystal violet, DiO6(3), JC-1, YOYO-1, DAPI, Hoechst 33342, FM 1-43, thiazole orange, primuline, thioflavin T, calcein blue, morin, naphthol blue black, fura-2, 4-amino-3-sulfo-1,8-naphthalimide, naphthalimide dyes, fluorescent pigments, and their derivatives.

The term "solvent dye"" is recognized in the art. Solubility in an organic solvent or solvents is a characteristics physical property of a solvent dye.

Representative examples of solvent dyes useful in the present compositions include, but are not limited to, Solvent Black 3, Solvent Black 5, Solvent Blue 14, Solvent Blue 35, Solvent Blue 38, Solvent Blue 43, Solvent Blue 59, Solvent Brown 1, Solvent Green 1, Solvent Green 3, Solvent Green 7, Solvent Green 11, Solvent Orange 1, Solvent Orange 2, Solvent Orange 7, Solvent Orange 15, Solvent Red 19, Solvent Red 23, Solvent Red 24, Solvent Red 26, Solvent Red 27, Solvent Red 41, Solvent Red 43, Solvent Red 45, Solvent Red 49, Solvent Red 72, Solvent Violet 8, Solvent Yellow 2, Solvent Yellow 3, Solvent Yellow 7, Solvent Yellow 14, Solvent Yellow 33, Solvent Yellow 94, manufactured by Sigma-Aldrich, St. Louis, Mo.; and Special Fluorescent Yellow 3G (Solvent Green 7), manufactured by Lanxess Corporation, Pittsburgh, Pa.

The terms "FD&C" and "D&C" dyes are recognized in the art. In the United States, colorants for food, drugs and cosmetics are regarded as "color additives". The Federal Food, Drug & Cosmetic (FD&C) Act of 1938 made food color additive certification mandatory. Since then the Food and Drug Administration (FDA) has been responsible for regulating all color additives used in food, drugs and cosmetics. Each batch to be sold in the United States has to be certified by the FDA. To avoid confusing color additives used in food with those manufactured for other uses, 3 categories of certifiable color additives were created: 1) FD&C (Food, Drug & Cosmetics) color additives with applications in food, drug & cosmetics; 2) D&C (Drug & Cosmetics) color additives with applications in drug & cosmetics; 3) External D&C (External Drug & Cosmetics) color additives with applications in externally applied drugs & in externally applied cosmetics. The use of all food colors approved for use in the United States are listed in 21 CFR (Code of Federal Regulation), parts 70 through 82 dealing with color additives.

Representative examples of FD&C dyes useful in compositions of the invention include, but are not limited to FD&C Blue 1, FD&C Blue 2, FD&C Green 3, FD&C Red 3, FD&C Red 40, FD&C Yellow 5, FD&C Yellow 6, Fast Emerald Green, and mixtures thereof, manufactured by Sensient Colors Inc., St. Louis, Mo., Vitasyn Tetrazine X 90, Vitasyn Orange RGL 90, Vitasyn Quinoline Yellow 70, Vitasyn Ponceau 4RC 82, Vitasyn Blue AE 90, Vitasyn Patent Blue V 85 01, Sanolin Flavin 8GZ, Sanolin Yellow BG, Sanolin Red NBG, Sanolin Rhodamine B, Sanolin Violet E2R, Sanolin Violet FBL, Sanolin Blue NBL, Sanolin Blue EHRL, Sanolin Blue EHRL Liquid, and mixtures thereof, manufactured by Clariant Corp., Coventry, R.I.

The term "polymeric colorant" is recognized in the art and polymeric colorants are a group of intermediate or high molar mass compounds that are intrinsically colored. Polymeric dyes may be defined through their applications as polymers and dyes, which possess suitably high tinctorial strength. Polymeric dyes are characterized by having polymeric chains covalently bonded to a chromophore (dye) molecule.

Representative examples of polymeric dyes useful in compositions of the invention include, but are not limited to, Palmer Orange B 113, Palmer Blue B232, Palmer Magenta, Palmer Fluorescent Red, Palmer Yellow R, Palmer Scarlett, Palmer Black B57, Palmer Patent Blue, LiquiTone Magenta 418, Polytint Violet X80LT, Polytint Orange X96, Polytint Yellow X15, Polytint Black X41LV, Polytint Red X64, Polytint Blue X3LV, & mixtures thereof, manufactured by Milliken & Co., Spartanburg, S.C.

Alternatively, pigments can be incorporated into the compositions of the invention. Suitable examples of pigments include those known as Hydrus™ (available from Salis International Inc./Dr. Ph. Martin's). Currently there are 24 Hydrus™ colors that can be used within the scope of the present invention.

Colorants (dyes and pigments) are included in the compositions of the invention in ranges from about 1% to about 90% by weight, more particularly from about 3% to about 30% by weight and in particular from about 5% to about 15% by weight.

The compositions of the present invention can be used with any simple or complex bubble making device, apparatus or machine to generate bubbles.

The compositions of the present invention provide bubbles that have at least average bubble integrity and lifespan. In particular embodiments, the compositions provide bubbles that maintain integrity and/or lifespan for 1 second to about 30 minutes, more particularly from about 2 seconds to about 20 minutes and most particularly from about 5 seconds to about 5 minutes.

The compositions of the present invention can be prepared by the following general method. A solution of colorant, humectant (glycerin) and/or water are stirred and heated at 50° C. for about 15 minutes and cooled to room temperature. Generally, additives such as deionized water, surfactant, preservatives, base and dye blockers are added and the reaction mixture further stirred for 2 hours at room temperature.

More particularly, a mixture of glycerin, dye (colorant) and deionized water was stirred and heated at 50° C. for about 15 minutes. The solution was cooled to room temperature, and a polyether surfactant, such as Methocel A4M and an alkyl metal sulfate, such as Colonial SLS (sodium lauryl sulfate) was added and stirred for 2 hours at room temperature. In generally, the solution should not be heated at 50° C. after the addition of the surfactant(s), otherwise the formulation may either precipitates out or may gel.

In another aspect, a mixture of glycerin, dye (colorant), deionized water, an alkyl sulfonate mixture with betaine, such as Miracare BC27 and an alkanolamide, such as Colamid C, was stirred and heated at 50° C. for about 15 minutes. The mixture was cooled to room temperature and stirred, generally for about 2 hours.

It has been found that is beneficial to add a preservative, such as Liquid Germall Plus, at room temperature.

After cooling, the compositions may be bottled. Alternately, the solution may be bottled without cooling.

To produce a substantially uniformly colored bubble for example, a dense, highly concentrated pigment or dye is used. It is desirable that the pigment or dye be non-toxic so that the bubble solution is suitable for use by children. Some suitable colorants include food colors or Hydrus™ (available from Salis International Inc./Dr. Ph. Martin's).

In a first embodiment, a composition heavily loaded with pigment may be used to produce a colored bubble. Such a composition can be formed by mixing a surfactant solution with a colorant. For example, a composition can be formed by mixing 10% Ultra Ivory™ (anionic and nonionic surfactant, ethyl alcohol, water, stabilizing agents, and perfume) and 90% Hydrus™. Another composition can be formed using 2% Ultra Concentrated Dawn™ (anionic and nonionic surfactant, ethyl alcohol, water, stabilizing agents, and perfume) and 98% of any D&C color. Yet another composition can be formed using 2% Ultra Concentrated Dawn™ (anionic and nonionic surfactant, ethyl alcohol, water, stabilizing agents, and perfume) and 98% D&C color. Such solutions are not typically completely washable from fabrics and/or skin.

A second embodiment provides a composition having less colorant. To form such a composition, the composition is heated and mixed in a manner provided by the present invention. A solution of water and surfactants is brought to a boil. The solution is actively stirred to prevent foaming. When the solution has reached a boil, the colorant is added during continued stirring. The solution is heated to approximately 90° C. The solution is kept at this temperature for approximately 3-10 minutes. The solution is then cooled. After cooling, the solution may be bottled. One composition uses 50% water, 25% colorant and 25% surfactant. However, these percentages may be varied and as little as approximately 10% colorant may be used. For example, a composition may use 80% water, 10% colorant, and 10% surfactant.

The present invention further includes kits that include the compositions of the invention and instructions how to use the compositions to form bubbles.

The present invention provides compositions and methods for producing substantially uniformly colored bubbles having a wide variety of opacities ranging from semi-transparent to opaque. The bubbles are substantially uniformly colored, or solidly colored, with approximately equal amounts of color on the top and the bottom of the bubble. Thus, the present invention does not produce bubbles having colorant streaking or a concentration of color at the bottom of the bubble as currently available solutions provide.

Aspects of the present teachings can be further understood in light of the following examples, which should not be construed as limiting the scope of the present teachings in any way.

EXAMPLES

1. Food Dyes/Acid Dyes

Example 1

| Chemical Component | Weight in grams |
|---|---|
| Glycerin | 10 |
| FD & C Blue 1 | 5 |
| Methocel A4M (4% solution in water) | 2.5 |
| Colonial SLS | 2.5 |
| Deionized water | 79.8 |

Liquid Germall Plus 0.2

FD & C Blue 1=C. I. Food Blue 2=C. I. Acid Blue 9

A mixture of glycerin, FD & C Blue 1, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 2

| Chemical Component | Weight in grams |
|---|---|
| Glycerin | 10 |
| FD & C Blue 2 | 5 |
| Methocel A4M (4% solution in water) | 2.5 |
| Colonial SLS | 2.5 |
| Deionized water | 79.8 |
| Liquid Germall Plus | 0.2 |

FD & C Blue 2=C. I. Food Blue 1

A mixture of glycerin, FD & C Blue 2, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 3

| Chemical Component | Weight in grams |
|---|---|
| Glycerin | 10 |
| FD & C Red 3 | 5 |
| Methocel A4M (4% solution in water) | 2.5 |
| Colonial SLS | 2.5 |
| Deionized water | 79.8 |
| Liquid Germall Plus | 0.2 |

FD & C Red 3=C. I. Food Red 14

A mixture of glycerin, FD & C Red 3, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 4

| Chemical Component | Weight in grams |
|---|---|
| Glycerin | 10 |
| FD & C Red 40 | 5 |
| Methocel A4M (4% solution in water) | 2.5 |
| Colonial SLS | 2.5 |
| Deionized water | 79.8 |
| Liquid Germall Plus | 0.2 |

FD & C Red 40=C. I. Food Red 17

A mixture of glycerin, FD & C Red 40, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 5

| Chemical Component | Weight in grams |
|---|---|
| Glycerin | 10 |
| Vitasyn Tetrazine X 90 | 5 |
| Methocel A4M (4% solution in water) | 2.5 |
| Colonial SLS | 2.5 |
| Deionized water | 79.8 |
| Liquid Germall Plus | 0.2 |

Vitasyn Tetrazine X 90=FD & C Yellow 5=C. I. Food Yellow 4=C. I. Acid Yellow 23

A mixture of glycerin, Vitasyn Tetrazine X 90, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 6

| Chemical Component | Weight in grams |
|---|---|
| Glycerin | 10 |
| Vitasyn Orange RGL 90 | 5 |
| Methocel A4M (4% solution in water) | 2.5 |
| Colonial SLS | 2.5 |
| Deionized water | 79.8 |
| Liquid Germall Plus | 0.2 |

Vitasyn Orange RGL 90=FD & C Yellow 6=C. I. Food Yellow 3

A mixture of glycerin, Vitasyn Orange RGL 90, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 7

| Chemical Component | Weight in grams |
|---|---|
| Glycerin | 10 |
| FD & C Green 3 | 5 |
| Methocel A4M (4% solution in water) | 2.5 |
| Colonial SLS | 2.5 |
| Deionized water | 79.8 |
| Liquid Germall Plus | 0.2 |

FD & C Green 3=C. I. Food Green 3

A mixture of glycerin, FD & C Green 3, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 8

| Chemical Component | Weight in grams |
|---|---|
| Glycerin | 10 |
| Fast Emerald Green | 5 |
| Methocel A4M (4% solution in water) | 2.5 |
| Colonial SLS | 2.5 |
| Deionized water | 79.8 |
| Liquid Germall Plus | 0.2 |

A mixture of glycerin, Fast Emerald Green, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 9

| Chemical Component | Weight in grams |
|---|---|
| Glycerin | 10 |
| Brilliant Black BN | 5 |
| Methocel A4M (4% solution in water) | 2.5 |
| Colonial SLS | 2.5 |
| Deionized water | 79.8 |
| Liquid Germall Plus | 0.2 |

Brilliant Black BN=C. I. Food Black 1

A mixture of glycerin, Brilliant Black BN, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 10

| Chemical Component | Weight in grams |
|---|---|
| Glycerin | 5 |
| FD & C Blue 1 | 5 |
| Colamid C | 2 |
| Miracare BC-27 | 7 |
| Deionized water | 80.8 |
| Liquid Germall Plus | 0.2 |

FD & C Blue 1=C. I. Food Blue 2=C. I. Acid Blue 9

A mixture of glycerin, FD & C Blue 1, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 11

| Chemical Component | Weight in grams |
|---|---|
| Glycerin | 5 |
| FD & C Blue 2 | 5 |
| Colamid C | 2 |
| Miracare BC-27 | 7 |
| Deionized water | 80.8 |
| Liquid Germall Plus | 0.2 |

FD & C Blue 2=C. I. Food Blue 1

A mixture of glycerin, FD & C Blue 2, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 12

| Chemical Component | Weight in grams |
|---|---|
| Glycerin | 5 |
| FD & C Red 3 | 5 |
| Colamid C | 2 |
| Miracare BC-27 | 7 |
| Deionized water | 80.8 |
| Liquid Germall Plus | 0.2 |

FD & C Red 3=C. I. Food Red 14

A mixture of glycerin, FD & C Red 3, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 13

| Chemical Component | Weight in grams |
|---|---|
| Glycerin | 5 |
| FD & C Red 40 | 5 |
| Colamid C | 2 |
| Miracare BC-27 | 7 |
| Deionized water | 80.8 |
| Liquid Germall Plus | 0.2 |

FD & C Red 40=C. I. Food Red 17

A mixture of glycerin, FD & C Red 40, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 14

| Chemical Component | Weight in grams |
|---|---|
| Glycerin | 5 |
| Vitasyn Tetrazine X 90 | 5 |
| Colamid C | 2 |
| Miracare BC-27 | 7 |
| Deionized water | 80.8 |
| Liquid Germall Plus | 0.2 |

Vitasyn Tetrazine X 90=FD & C Yellow 5=C. I. Food Yellow 4=C. I. Acid Yellow 23

A mixture of glycerin, Vitasyn Tetrazine X 90, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 15

| Chemical Component | Weight in grams |
|---|---|
| Glycerin | 5 |
| Vitasyn Orange RGL 90 | 5 |
| Colamid C | 2 |
| Miracare BC-27 | 7 |
| Deionized water | 80.8 |
| Liquid Germall Plus | 0.2 |

Vitasyn Orange RGL 90=FD & C Yellow 6=C. I. Food Yellow

A mixture of glycerin, Vitasyn Orange RGL 90, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 16

| Chemical Component | Weight in grams |
|---|---|
| Glycerin | 5 |
| FD & C Green 3 | 5 |
| Colamid C | 2 |
| Miracare BC-27 | 7 |
| Deionized water | 80.8 |
| Liquid Germall Plus | 0.2 |

FD & C Green 3=C. I. Food Green 3

A mixture of glycerin, FD & C Green 3, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 17

| Chemical Component | Weight in grams |
|---|---|
| Glycerin | 5 |
| Fast Emerald Green | 5 |
| Colamid C | 2 |
| Miracare BC-27 | 7 |
| Deionized water | 80.8 |
| Liquid Germall Plus | 0.2 |

A mixture of glycerin, Fast Emerald Green, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 18

| Chemical Component | Weight in grams |
|---|---|
| Glycerin | 5 |
| Brilliant Black BN | 5 |
| Colamid C | 2 |
| Miracare BC-27 | 7 |
| Deionized water | 80.8 |
| Liquid Germall Plus | 0.2 |

Brilliant Black BN=C. I. Food Black 1

A mixture of glycerin, Brilliant Black BN, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 19

| Chemical Component | Unites |
|---|---|
| Glycerin | 5 ml |
| FD&C Blue No. 2 | 30 ml |
| Ivory Soap | 5 ml |
| Deionized water | 230 ml |

FD&C Blue No. 2

230 ml water, 5 ml Ivory soap, and 5 ml glycerin were mixed in a pan or other suitable container. The resultant solution was brought to a boil. 30 ml FD&C Blue No. 2 was then added and the solution was boiled and stirred for 4 minutes. The solution was quickly cooled by placing in a bowl of ice water. The resulting composition produced light blue generally uniformly colored bubbles. The formula is somewhat difficult to remove from skin and washes out of cotton.

Table 1 shows color of the colored bubbles using food dyes/acid dyes in various Examples 1 through 19 as given below:

TABLE 1

Color of the colored bubbles using food dyes/acid dyes

| Example # | Color of the Colored Bubbles |
|---|---|
| Example 1 | Bright Blue |
| Example 2 | Dull Blue |
| Example 3 | Bright Red |
| Example 4 | Pale Red |
| Example 5 | Bright Yellow |
| Example 6 | Bright Orange |
| Example 7 | Dull Green |
| Example 8 | Bright Green |
| Example 9 | Light Black |
| Example 10 | Bright Blue |
| Example 11 | Dull Blue |
| Example 12 | Bright Red |
| Example 13 | Pale Red |
| Example 14 | Bright Yellow |
| Example 15 | Bright Orange |
| Example 16 | Dull Green |
| Example 17 | Bright Green |
| Example 18 | Light Black |
| Example 19 | Light Blue |

2. Polymeric Dyes

Example 1

| Chemical Component | Weight in grams |
|---|---|
| Glycerin | 10 |
| Palmer Blue B232 | 25 |
| Methocel A4M (4% solution in water) | 2.5 |
| Colonial SLS | 2.5 |
| Deionized water | 59.8 |
| Liquid Germall Plus | 0.2 |

A mixture of glycerin, Palmer Blue B232, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 2

| Chemical Component | Weight in grams |
|---|---|
| Glycerin | 10 |
| Palmer Scarlett | 25 |
| Methocel A4M (4% solution in water) | 2.5 |
| Colonial SLS | 2.5 |
| Deionized water | 59.8 |
| Liquid Germall Plus | 0.2 |

A mixture of glycerin, Palmer Scarlett, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 3

| Chemical Component | Weight in grams |
|---|---|
| Glycerin | 10 |
| Palmer Yellow R | 25 |
| Methocel A4M (4% solution in water) | 2.5 |
| Colonial SLS | 2.5 |
| Deionized water | 59.8 |
| Liquid Germall Plus | 0.2 |

A mixture of glycerin, Palmer Yellow R, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 4

| Chemical Component | Weight in grams |
|---|---|
| Glycerin | 10 |
| Palmer Magenta | 25 |
| Methocel A4M (4% solution in water) | 2.5 |
| Colonial SLS | 2.5 |
| Deionized water | 59.8 |
| Liquid Germall Plus | 0.2 |

A mixture of glycerin, Palmer Magenta, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 5

| Chemical Component | Weight in grams |
|---|---|
| Glycerin | 10 |
| Palmer FL Red | 25 |
| Methocel A4M (4% solution in water) | 2.5 |
| Colonial SLS | 2.5 |
| Deionized water | 59.8 |
| Liquid Germall Plus | 0.2 |

A mixture of glycerin, Palmer FL Red, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 6

| Chemical Component | Weight in grams |
|---|---|
| Glycerin | 10 |
| Palmer Orange B113 | 25 |
| Methocel A4M (4% solution in water) | 2.5 |
| Colonial SLS | 2.5 |
| Deionized water | 59.8 |
| Liquid Germall Plus | 0.2 |

A mixture of glycerin, Palmer Orange B113, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 7

| Chemical Component | Weight in grams |
|---|---|
| Glycerin | 10 |
| Palmer Black B57 | 25 |
| Methocel A4M (4% solution in water) | 2.5 |
| Colonial SLS | 2.5 |
| Deionized water | 59.8 |
| Liquid Germall Plus | 0.2 |

A mixture of glycerin, Palmer Black B57, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 8

| Chemical Component | Weight in grams |
|---|---|
| Glycerin | 10 |
| Palmer Patent Blue | 25 |
| Methocel A4M (4% solution in water) | 2.5 |
| Colonial SLS | 2.5 |

-continued

| Chemical Component | Weight in grams |
|---|---|
| Deionized water | 59.8 |
| Liquid Germall Plus | 0.2 |

A mixture of glycerin, Palmer Patent Blue, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 9

| Chemical Component | Weight in grams |
|---|---|
| Glycerin | 10 |
| LiquiTone Magenta 418 | 25 |
| Methocel A4M (4% solution in water) | 2.5 |
| Colonial SLS | 2.5 |
| Deionized water | 59.8 |
| Liquid Germall Plus | 0.2 |

A mixture of glycerin, LiquiTone Magenta 418, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 10

| Chemical Component | Weight in grams |
|---|---|
| Glycerin | 5 |
| Palmer Blue B232 | 25 |
| Colamid C | 2 |
| Miracare BC-27 | 7 |
| Deionized water | 60.8 |
| Liquid Germall Plus | 0.2 |

A mixture of glycerin, Palmer Blue B232, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 11

| Chemical Component | Weight in grams |
|---|---|
| Glycerin | 5 |
| Palmer Scarlett | 25 |
| Colamid C | 2 |
| Miracare BC-27 | 7 |
| Deionized water | 60.8 |
| Liquid Germall Plus | 0.2 |

A mixture of glycerin, Palmer Scarlett, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 12

| Chemical Component | Weight in grams |
|---|---|
| Glycerin | 5 |
| Palmer Yellow R | 25 |
| Colamid C | 2 |
| Miracare BC-27 | 7 |
| Deionized water | 60.8 |
| Liquid Germall Plus | 0.2 |

A mixture of glycerin, Palmer Yellow R, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 13

| Chemical Component | Weight in grams |
|---|---|
| Glycerin | 5 |
| Palmer Magenta | 25 |
| Colamid C | 2 |
| Miracare BC-27 | 7 |
| Deionized water | 60.8 |
| Liquid Germall Plus | 0.2 |

A mixture of glycerin, Palmer Magenta, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 14

| Chemical Component | Weight in grams |
|---|---|
| Glycerin | 5 |
| Palmer FL Red | 25 |
| Colamid C | 2 |
| Miracare BC-27 | 7 |
| Deionized water | 60.8 |
| Liquid Germall Plus | 0.2 |

A mixture of glycerin, Palmer FL Red, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 15

| Chemical Component | Weight in grams |
|---|---|
| Glycerin | 5 |
| Palmer Orange B113 | 25 |
| Colamid C | 2 |
| Miracare BC-27 | 7 |
| Deionized water | 60.8 |
| Liquid Germall Plus | 0.2 |

A mixture of glycerin, Palmer Orange B113, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 16

| Chemical Component | Weight in grams |
|---|---|
| Glycerin | 5 |
| Palmer Black B57 | 25 |
| Colamid C | 2 |
| Miracare BC-27 | 7 |
| Deionized water | 60.8 |
| Liquid Germall Plus | 0.2 |

A mixture of glycerin, Palmer Black B57, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 17

| Chemical Component | Weight in grams |
|---|---|
| Glycerin | 5 |
| Palmer Patent Blue | 25 |
| Colamid C | 2 |
| Miracare BC-27 | 7 |
| Deionized water | 60.8 |
| Liquid Germall Plus | 0.2 |

A mixture of glycerin, Palmer Patent Blue, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 18

| Chemical Component | Weight in grams |
|---|---|
| Glycerin | 5 |
| LiquiTone Magenta 418 | 25 |
| Colamid C | 2 |
| Miracare BC-27 | 7 |

-continued

| Chemical Component | Weight in grams |
|---|---|
| Deionized water | 60.8 |
| Liquid Germall Plus | 0.2 |

A mixture of glycerin, LiquiTone Magenta 418, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 19

| Chemical Component | Units |
|---|---|
| Glycerin | 1 ml |
| Triethanolamine | 1 ml |
| Deionized water | 9 ml |
| Ivory Soap | 20 ml |
| Soap solution total | 31 ml |
| National Ink, LLC Super washable blue | 30 ml |
| Soap solution | 10 ml |

A soap solution was formed by mixing 20 ml of Ivory dishwashing detergent, 1 ml triethanolamine, 9 ml water and 1 ml glycerin. 30 ml National Ink, LLC Super washable blue and 10 ml of the soap solution were added to the soap solution. The resulting composition produced bubbles that were vividly colored. The formula washed easily from skin and out of cotton, polyester, linen, knit and cotton/poly blends.

Example 20

| Chemical Component | Units |
|---|---|
| National Ink, LLC. Super washable blue | 30 ml |
| Ivory Soap | 10 ml |

Figure 1B:
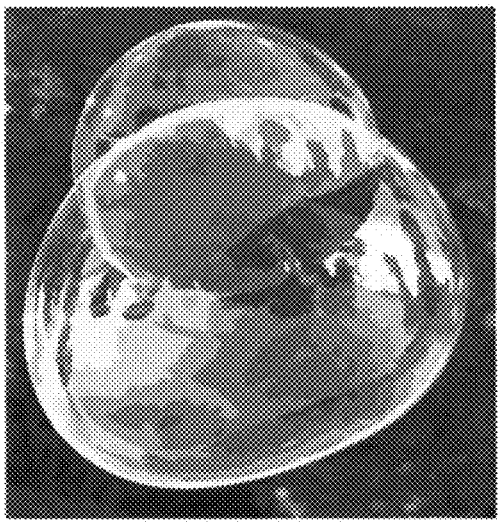
FIG. 1*b* is an exemplary substantially uniformly colored bubble prepared by a composition and method of the present invention.
Figure 2A:
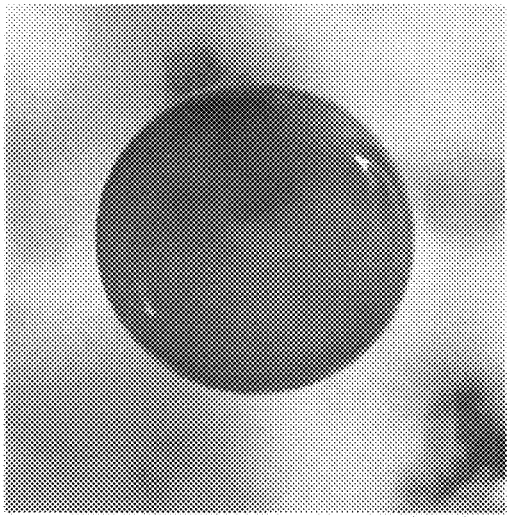
FIG. 2*a* is an exemplary substantially uniformly colored bubble that has the blue dye dispersed uniformly throughout the surface of the bubble and does not exhibit concentration of pigment at the bottom portion of the bubble.
Figure 2B:
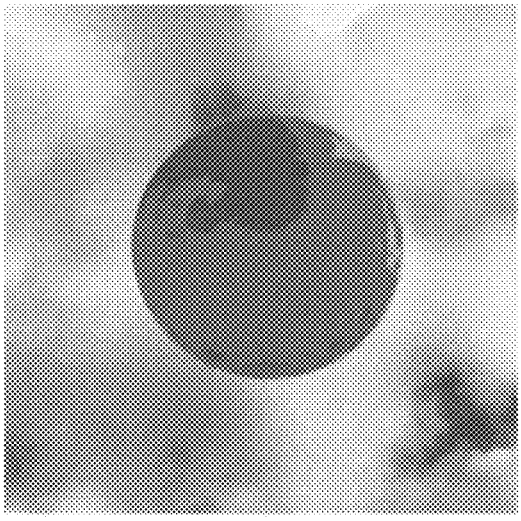
FIG. 2*b* is an exemplary substantially uniformly colored bubble that has the blue dye dispersed uniformly throughout the surface of the bubble "swirled" characteristic to the bubble surface.
Figure 3A:
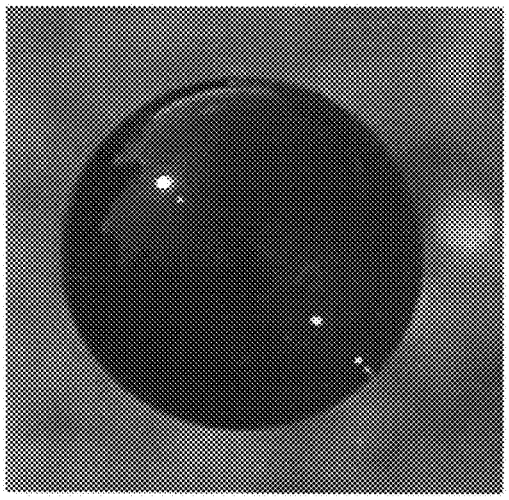
FIG. 3*a* is an exemplary substantially uniformly colored bubble that has the dark blue dye dispersed uniformly throughout the surface of the bubble and does not exhibit concentration of pigment at the bottom portion of the bubble.
Figure 3B:
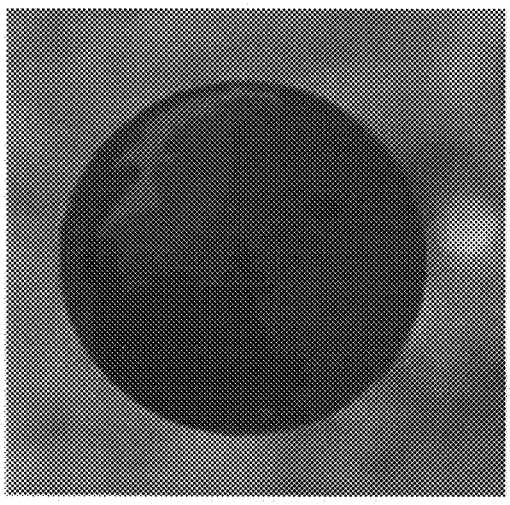
FIG. 3*b* is an exemplary substantially uniformly colored bubble that has the dark blue dye dispersed uniformly throughout the surface of the bubble "swirled" characteristic to the bubble surface.
Figure 4A:
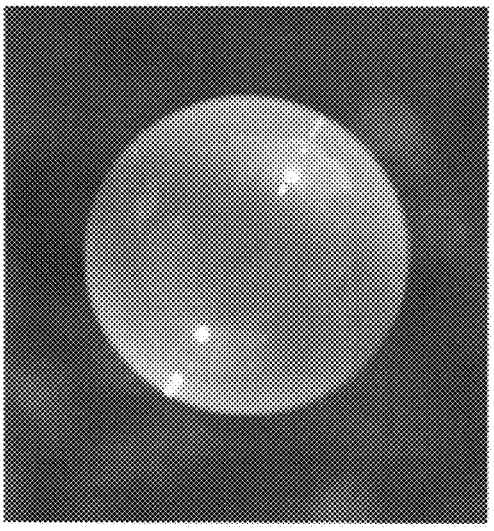
FIG. 4*a* is an exemplary substantially uniformly colored bubble that has the green dye dispersed uniformly throughout the surface of the bubble and does not exhibit concentration of pigment at the bottom portion of the bubble.
Figure 4B:
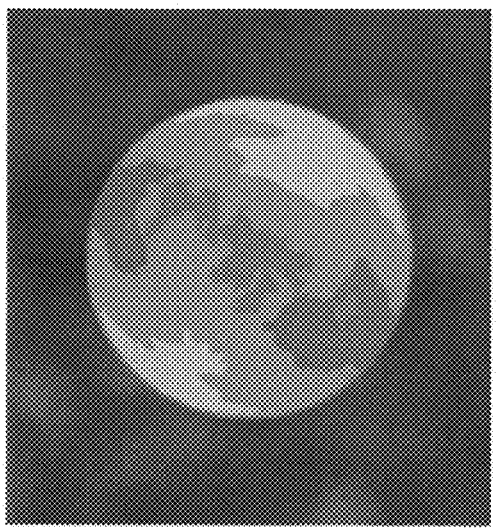
FIG. 4*b* is an exemplary substantially uniformly colored bubble that has the green dye dispersed uniformly throughout the surface of the bubble "swirled" characteristic to the bubble surface.
Figure 5:
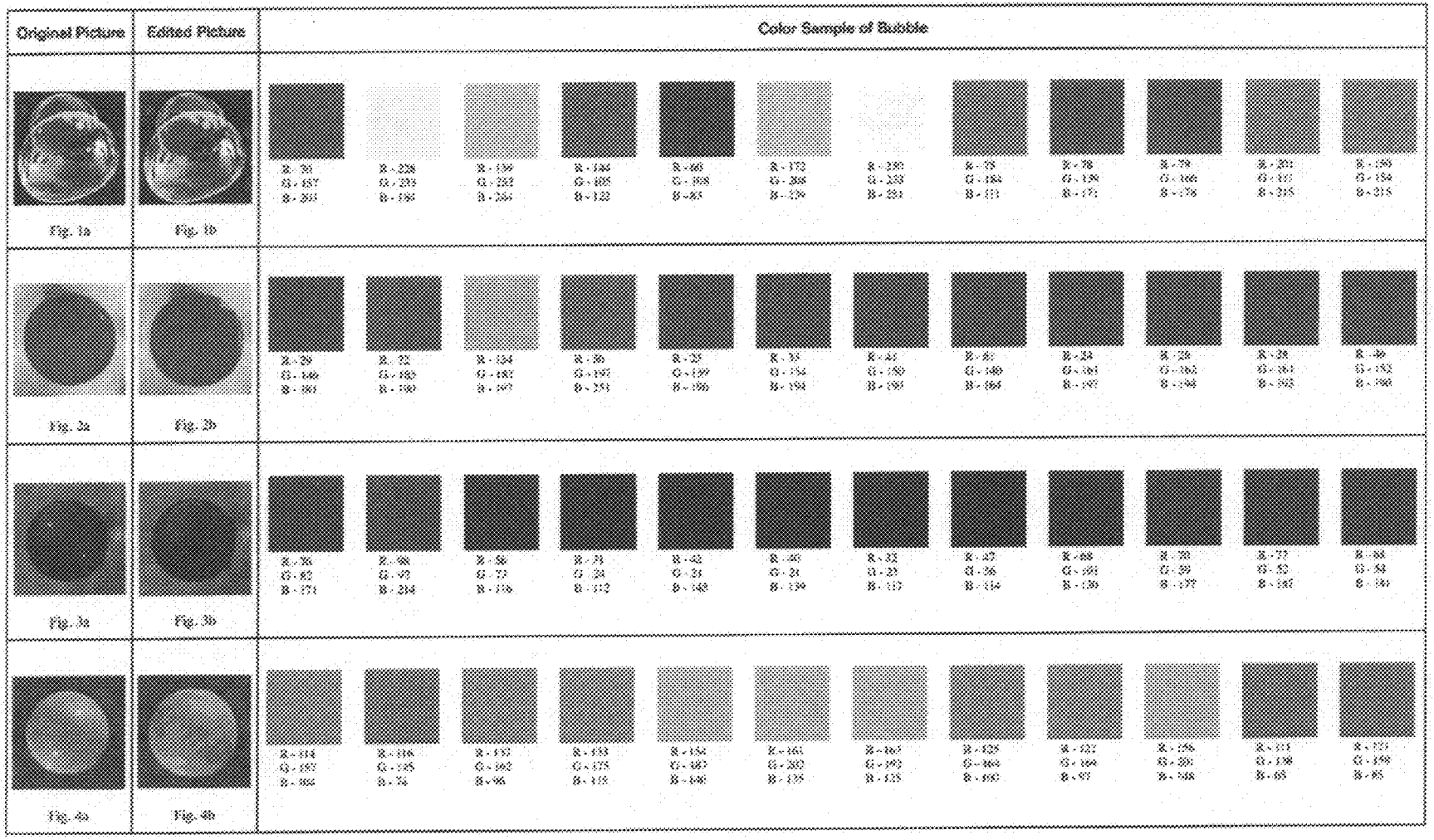
FIG. 5 is an exemplary color sample of bubbles.

30 ml National Ink LLC Super washable blue and 10 ml Ivory soap were mixed. The resulting composition produced vividly colored bubbles. The formula washed easily from skin and out of cotton, polyester, and cotton/poly blends. FIG. 1 graphically depicts a bubble formed from this solution.

Table 2 shows color of the colored bubbles using polymeric dyes in various Examples 1 through 20 as given below:

TABLE 2

Color of the colored bubbles using polymeric dyes

| Example # | Color of the Colored Bubbles |
|---|---|
| Example 1 | Blue |
| Example 2 | Scarlet |
| Example 3 | Yellow |
| Example 4 | Magenta |
| Example 5 | Fluorescent Red |
| Example 6 | Orange |
| Example 7 | Pale Black |
| Example 8 | Blue |
| Example 9 | Magenta |
| Example 10 | Blue |
| Example 11 | Scarlet |

TABLE 2-continued

Color of the colored bubbles using polymeric dyes

| Example # | Color of the Colored Bubbles |
|---|---|
| Example 12 | Yellow |
| Example 13 | Magenta |
| Example 14 | Fluorescent Red |
| Example 15 | Orange |
| Example 16 | Pale Black |
| Example 17 | Blue |
| Example 18 | Magenta |
| Example 19 | Blue |
| Example 20 | Blue |

3. Fluorescent Dyes

Example 1

| Chemical Component | Weight in grams |
|---|---|
| Glycerin | 10 |
| Fluorescein (Na salt) | 5 |
| Methocel A4M (4% solution in water) | 2.5 |
| Colonial SLS | 2.5 |
| Deionized water | 79.8 |
| Liquid Germall Plus | 0.2 |

A mixture of glycerin, Fluorescein (Na salt), deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 2

| Chemical Component | Weight in grams |
|---|---|
| Glycerin | 10 |
| Rhodamine B | 5 |
| Methocel A4M (4% solution in water) | 2.5 |
| Colonial SLS | 2.5 |
| Deionized water | 79.8 |
| Liquid Germall Plus | 0.2 |

A mixture of glycerin, Rhodamine B, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 3

| Chemical Component | Weight in grams |
|---|---|
| Glycerin | 10 |
| Rhodamine 6G | 5 |
| Methocel A4M (4% solution in water) | 2.5 |
| Colonial SLS | 2.5 |
| Deionized water | 79.8 |
| Liquid Germall Plus | 0.2 |

A mixture of glycerin, Rhodamine 6G, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 4

| Chemical Component | Weight in grams |
|---|---|
| Glycerin | 10 |
| Rhodamine 123 | 5 |
| Methocel A4M (4% solution in water) | 2.5 |
| Colonial SLS | 2.5 |
| Deionized water | 79.8 |
| Liquid Germall Plus | 0.2 |

A mixture of glycerin, Rhodamine 123, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 5

| Chemical Component | Weight in grams |
|---|---|
| Glycerin | 10 |
| Eosin Y | 5 |
| Methocel A4M (4% solution in water) | 2.5 |
| Colonial SLS | 2.5 |
| Deionized water | 79.8 |
| Liquid Germall Plus | 0.2 |

A mixture of glycerin, Eosin Y, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 6

| Chemical Component | Weight in grams |
|---|---|
| Glycerin | 10 |
| Naphthol Blue Black | 5 |
| Methocel A4M (4% solution in water) | 2.5 |
| Colonial SLS | 2.5 |
| Deionized water | 79.8 |
| Liquid Germall Plus | 0.2 |

A mixture of glycerin, Naphthol Blue Black, deionized water was stirred and heated at 50° C. for 15 minutes, cooled to room temperature, followed by addition of Methocel A4M, Colonial SLS, & Liquid Germall Plus. The reaction mixture was further stirred for 2 hours at room temperature.

Example 7

| Chemical Component | Weight in grams |
|---|---|
| Glycerin | 5 |
| Fluorescein (Na salt) | 5 |
| Colamid C | 2 |
| Miracare BC-27 | 7 |
| Deionized water | 80.8 |
| Liquid Germall Plus | 0.2 |

A mixture of glycerin, Fluorescein (Na salt), Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 8

| Chemical Component | Weight in grams |
|---|---|
| Glycerin | 5 |
| Rhodamine B | 5 |
| Colamid C | 2 |
| Miracare BC-27 | 7 |
| Deionized water | 80.8 |
| Liquid Germall Plus | 0.2 |

A mixture of glycerin, Rhodamine B, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 9

| Chemical Component | Weight in grams |
|---|---|
| Glycerin | 5 |
| Rhodamine 6G | 5 |
| Colamid C | 2 |
| Miracare BC-27 | 7 |
| Deionized water | 80.8 |
| Liquid Germall Plus | 0.2 |

A mixture of glycerin, Rhodamine 6G, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 10

| Chemical Component | Weight in grams |
|---|---|
| Glycerin | 5 |
| Rhodamine 123 | 5 |
| Colamid C | 2 |
| Miracare BC-27 | 7 |
| Deionized water | 80.8 |
| Liquid Germall Plus | 0.2 |

A mixture of glycerin, Rhodamine 123, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 11

| Chemical Component | Weight in grams |
|---|---|
| Glycerin | 5 |
| Eosin Y | 5 |
| Colamid C | 2 |
| Miracare BC-27 | 7 |
| Deionized water | 80.8 |
| Liquid Germall Plus | 0.2 |

A mixture of glycerin, Eosin Y, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Example 12

| Chemical Component | Weight in grams |
|---|---|
| Glycerin | 5 |
| Naphthol Blue Black | 5 |
| Colamid C | 2 |
| Miracare BC-27 | 7 |
| Deionized water | 80.8 |
| Liquid Germall Plus | 0.2 |

A mixture of glycerin, Naphthol Blue Black, Colamid C, Miracare BC-27, deionized water was stirred and heated at 50° C. for 15 minutes, cooled to room temperature, followed by addition of Liquid Germall Plus. The reaction mixture was further stirred for 2 hours at room temperature.

Table 3 shows color of the colored bubbles using fluorescent dyes in various Examples 1 through 12 as given below:

TABLE 3

Color of the colored bubbles using fluorescent dyes

| Example # | Color of the Colored Bubbles |
|---|---|
| Example 1 | Bright yellow with intense green fluorescence |
| Example 2 | Pink with intense orange fluorescence |
| Example 3 | Pink with intense yellow fluorescence |
| Example 4 | Pink with intense yellow fluorescence |
| Example 5 | Red with intense green fluorescence |
| Example 6 | Bluish-green with blue fluorescence |
| Example 7 | Bright yellow with intense green fluorescence |
| Example 8 | Pink with intense orange fluorescence |
| Example 9 | Pink with intense yellow fluorescence |
| Example 10 | Pink with intense yellow fluorescence |
| Example 11 | Red with intense green fluorescence |
| Example 12 | Bluish-green with blue fluorescence |

4. Pigments

Example 1

Lightly Colored Bubbles of Various Colors 230 ml water, 5 ml Ivory soap, and 5 ml glycerin were mixed in a pan or other suitable container. The resultant solution was brought to a boil. 30 ml Hydrus was then added and the solution was boiled and stirred for 4 minutes. The solution was quickly cooled by placing in a bowl of ice water. The resulting composition produced generally uniformly colored bubbles lightly shaded in the color of Hydrus used (currently available in 24 colors). The formula washed easily from skin but stains clothing.

Example 2

Vividly Colored Bubbles of Various Colors 230 ml water, 15 ml Ivory soap and 1 ml glycerin were mixed in a pan or other suitable container. The resultant solution was brought to a boil. 30 ml Hydrus was then added and the solution was boiled and stirred for 5 minutes. The solution was quickly cooled by placing in a bowl of ice water. The resulting composition produced generally uniformly colored bubbles lightly shaded in the color of Hydrus used (currently available in 24 colors). The formula washes easily from skin but stains clothing. Bubbles produced using this composition do not typically pop immediately upon contact with a surface.

Example 3

Lightly Tinted Bubbles of Various Colors 345 ml water, 230 ml Ivory soap and 15 ml glycerin were mixed in a pan or other suitable container. The resultant solution was brought to a boil, 30 ml Hydrus were added and then the solution was boiled and stirred for 7 minutes. The resulting composition produced bubbles that were color tinted in the color of Hydrus used (currently available in 24 colors) but mostly transparent.

Example 4

Lightly Colored Bubbles of Various Colors 175 ml water, 60 ml Ivory soap and 30 ml glycerin were mixed in a pan or other suitable container. The resultant solution was brought to a boil, 30 ml Hydrus were added and then the solution was boiled and stirred for 10 minutes. The resulting composition produced bubbles that were lightly colored in the color of Hydrus used (currently available in 24 colors).

Example 5

Vividly Colored Bubbles of Various Colors 175 ml water, 50 ml Ivory soap and 2.5 ml glycerin were mixed in a pan or other suitable container. The resultant solution was brought to a boil, 60 ml Hydrus were added and the solution was boiled and stirred for 7 minutes. The resulting composition produced bubbles that were vividly colored in the color of Hydrus used (currently available in 24 colors).

Example 6

Vividly Colored Bubbles of Various Colors 30 ml Hydrus and 4 ml Ivory were mixed. The resulting composition produced bubbles that were vividly colored in the color of Hydrus used (currently available in 24 colors).

Example 7

Vividly Colored Bubbles of Various Colors with Buttered Popcorn Scent 30 ml Hydrus, 4 ml Ivory and 1 ml popcorn scent were mixed. The resulting composition produced bubbles that were vividly colored in the color of Hydrus used (currently available in 24 colors) that smelled like buttered popcorn.

Example 8

Colored Bubbles 200 ml water and 60 ml Ivory soap were mixed in a pan or other suitable container. The resultant solution was brought to a boil, 30 ml Hydrus were added and the solution was boiled and stirred for 3 minutes. The resulting composition produces bubbles in the color of Hydrus used (currently available in 24 colors).

Although the present invention has been described with reference to preferred embodiments, persons skilled in the art will recognize that changes may be made in form and detail without departing from the spirit and scope of the invention. All references cited throughout the specification, including those in the background, are incorporated herein in their entirety. Those skilled in the art will recognize, or be able to ascertain, using no more than routine experimentation, many equivalents to specific embodiments of the invention described specifically herein. Such equivalents are intended to be encompassed in the scope of the following claim.

We claim:

1. A thin film forming a colored bubble comprising:

a colored bubble having a single color uniformly dispersed in the thin film, comprising:

water;

a surfactant; and a colorant, wherein the colorant is uniformly dispersed in the thin film; and wherein the bubble is uniformly colored by the colorant.

2. The colored bubble of claim 1, wherein the colorant is an acid dye, FD&C dye, food dye, a polymeric dye, a pigment, or a combination thereof.

3. The colored bubble of claim 2, wherein the surfactant is a polyether, an alkyl metal sulfate, a betaine, an alkanolamide or a combination thereof.

4. The colored bubble of claim 3, wherein the polyether surfactant is a cellulose ether surfactant.

5. The colored bubble of claim 3, wherein the alkyl metal sulfate is sodium lauryl sulfate.

6. The colored bubble of claim 3, wherein the surfactant is a combination of a polyether surfactant and an alkyl metal sulfate.

7. The colored bubble of claim 6, wherein the polyether surfactant is a cellulose ether surfactant and the alkyl metal sulfate is sodium lauryl sulfate.

8. The colored bubble of claim 3, wherein the surfactant is a combination of an alkyl metal sulfate, a betaine and an alkanolamide.

9. The colored bubble of claim 2, wherein the colorant is an acid dye and the surfactant is a combination of a polyether surfactant and an alkyl metal sulfate.

10. The colored bubble of claim 2, wherein the colorant is a pigment and the surfactant is a combination of a polyether surfactant and an alkyl metal sulfate.

11. The colored bubble of claim 2, wherein the colorant is an acid dye and the surfactant is a combination of an alkyl metal sulfate and an alkanolamide.

12. The colored bubble of claim 2, wherein the colorant is a pigment and the surfactant is a combination of an alkyl metal sulfate and an alkanolamide.

13. A method to prepare a thin film forming bubble solution for a colored bubble having a single color uniformly dispersed in the thin film, comprising the steps of:

heating a mixture of glycerin, colorant and water to a temperature below about 60° C.;

cooling the mixture;

adding a surfactant to the cooled mixture; and preparing a colored bubble solution.

14. The method of claim 13, wherein the colorant is an acid dye, FD&C dye, food dye, a polymeric dye, a pigment, or a combination thereof.

15. The method of claim 14, wherein the surfactant is a polyether, an alkyl metal sulfate, or a combination thereof.

16. The method of claim 15, wherein the polyether surfactant is a cellulose ether surfactant.

17. The method of claim 15, wherein the alkyl metal sulfate is sodium lauryl sulfate.

18. The method of claim 15, wherein the surfactant is a combination of a polyether surfactant and an alkyl metal sulfate.

19. The method of claim 18, wherein the polyether surfactant is a cellulose ether surfactant and the alkyl metal sulfate is sodium lauryl sulfate.

20. The method of claim 14, wherein the mixture of glycerin, colorant and water are heated for less than 30 minutes.

21. The method of claim 14, wherein the colorant is an acid dye, FD&C dye, food dye, a polymeric dye or a combination thereof.

22. The method of claim 21, wherein the surfactant is a combination of a polyether surfactant and an alkyl metal sulfate.

23. The method of claim 22, wherein the polyether surfactant is a cellulosic ether surfactant and the alkyl metal sulfate is sodium lauryl sulfate.

24. A method to prepare a thin film forming bubble solution for a colored bubble having a single color uniformly dispersed in the thin film, comprising the steps of:

combining glycerin, colorant, water, an alkanolamide and an alkyl metal sulfate to form a mixture; and heating the mixture to a temperature below about 60° C.;

wherein a colored bubble having a color provided by the colorant uniformly dispersed in the bubble is formed therefrom.

25. The method of claim 24, wherein the colorant is an acid dye, FD&C dye, food dye, a polymeric dye, a pigment, or a combination thereof.

26. The method of claim 25, wherein the surfactant is an alkanolamide and at least an alkyl metal sulfate.

27. The method of claim 26, wherein the surfactant further comprises sodium trideceyl sulfate, water, PEG 80 sorbitant laurate, cocamidopropyl betaine, sodium lauroamphoacetate, PEG 150 distearate, sodium laureth-13 carboxylate, glycerin, citric acid, tetrasodium EDTA and quaternium-15.

28. The colored bubble of claim 1 wherein a solution for forming the thin film comprises:

2%-20% of a colorant by weight;

2%-20% of a surfactant by weight; and water;

wherein the solution allows for the formation of a colored bubble having a single color uniformly dispersed in the thin film.

29. The colored bubble of claim 28, wherein the colorant is a washable ink or a washable pigment.

30. The colored bubble of claim 28, wherein the surfactant is sodium lauryl sulfate or an anionic/amphoteric surfactant.

31. The colored bubble of claim 28, wherein the water is deionized water.

32. The colored bubble of claim 28, wherein the colorant is a washable ink or a washable pigment, the surfactant is sodium lauryl sulfate or an anionic/amphoteric surfactant and the water is deionized water.

33. The colored bubble of claim 28, wherein the surfactant is an anionic/amphoteric blend.

* * * * *

US007910531C1

(12) INTER PARTES REEXAMINATION CERTIFICATE (0429th)

United States Patent
Sabnis et al.

(10) Number: US 7,910,531 C1
(45) Certificate Issued: Aug. 14, 2012

(54) COMPOSITION AND METHOD FOR PRODUCING COLORED BUBBLES

(75) Inventors: Ram W. Sabnis, Eagan, MN (US); Timothy D. Kehoe, St. Paul, MN (US)

(73) Assignee: Crayola LLC

Reexamination Request:
No. 95/001,582, Mar. 22, 2011

Reexamination Certificate for:

| | |
|---|---|
| Patent No.: | **7,910,531** |
| Issued: | **Mar. 22, 2011** |
| Appl. No.: | **11/150,975** |
| Filed: | **Jun. 13, 2005** |

Related U.S. Application Data

(60) Provisional application No. 60/581,294, filed on Jun. 17, 2004.

(51) Int. Cl.
*C11D 3/40* (2006.01)

(52) U.S. Cl. ..... 510/100; 252/585; 524/253

(58) Field of Classification Search ..... None
See application file for complete search history.

(56) References Cited

To view the complete listing of prior art documents cited during the proceeding for Reexamination Control Number 95/001,582, please refer to the USPTO's public Patent Application Information Retrieval (PAIR) system under the Display References tab.

*Primary Examiner*—Johnny F Railey

(57) ABSTRACT

Compositions and methods for producing colored bubbles, having a single color uniformly dispersed in the film, are described. The composition comprises at least one surfactant mixed with at least one colorant, the colorant forming at least approximately 10% of the composition. The surfactant, or surface-active agent, forms the bubble while the colorant, or pigment, provides the color. Generally, the composition may comprise 10-99% colorant to produce varying degrees of opacity. In addition, glycerin, fragrance, propylene glycol, sodium lauryl sulfate, potassium hydroxide, or other additives may be included.

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

The patentability of claims 15-19, 21-23 and 25-27 is confirmed.

Claims 1-14, 20, 24 and 28-33 are cancelled.

* * * * *